US005497525A

United States Patent [19]

Woodgate

[11] Patent Number: 5,497,525

[45] Date of Patent: Mar. 12, 1996

[54] APPARATUS FOR REMOVING AND COLLECTING COATINGS FROM GAME CARDS

[75] Inventor: Daniel E. Woodgate, Austin, Tex.

[73] Assignee: Gate Mold, Inc., Round Rock, Tex.

[21] Appl. No.: 325,999

[22] Filed: Oct. 19, 1994

[51] Int. Cl.[6] ..... A47L 13/02; B26B 3/00

[52] U.S. Cl. ..... 15/104.8; 15/236.05; 15/236.01; 30/172; 30/279.2

[58] Field of Search ..... 15/236.01, 236.06, 15/236.05, 236.02, 104.8; 30/169, 172, 173, 279.2, 280, 478; D32/46

[56] References Cited

U.S. PATENT DOCUMENTS

| | | | |
|---|---|---|---|
| 2,236,093 | 3/1941 | Friend | 15/236.06 |
| 2,649,604 | 8/1953 | Hess | 15/236.01 |
| 2,777,195 | 1/1957 | Dalianis | 30/279.2 |
| 2,879,530 | 3/1959 | Ego | 15/104.8 |
| 4,574,417 | 3/1986 | Magnasco | 15/236.05 |
| 4,646,382 | 3/1987 | Smith | 15/236.01 |
| 4,654,923 | 4/1987 | Faciane et al. | 15/236.01 |
| 4,777,693 | 10/1988 | Diba et al. | 15/236.01 |
| 4,793,061 | 12/1988 | Rizzo, Jr. | 30/169 |
| 4,881,291 | 11/1989 | Ellis | 15/236.01 |
| 5,235,751 | 8/1993 | Landgraf | 30/280 |

*Primary Examiner*—Edward L. Roberts, Jr.
*Attorney, Agent, or Firm*—Baker & Botts

[57] ABSTRACT

A device (10) for scraping coatings from cards includes first and second housing members (12 and 14). These housing members define a cavity (20). Blades (22 and 24) scrape coatings off of cards in opposite directions. Removed coatings are collected in the cavity (20).

30 Claims, 3 Drawing Sheets

APPARATUS FOR REMOVING AND COLLECTING COATINGS FROM GAME CARDS

TECHNICAL FIELD OF THE INVENTION

This invention relates generally to the fields of game cards and debris collection, and, more particularly, to a method and apparatus for removing and collecting coatings from game cards.

BACKGROUND OF THE INVENTION

Lottery and prize-giveaway programs are time-honored techniques for raising money and promoting products. In recent years, the proliferation of such programs has been rather astounding, with much of the increase occurring because more and more states are sponsoring lottery programs as a way of generating revenue.

The scratch-off game card is a very popular way of presenting many lottery and prize-giveaway programs. With scratch-off game cards, a coating (or "paint") is laid down over giveaway information, and the purchaser scratches off the paint to reveal the giveaway information. Of course, the purchaser hopes that the giveaway information under the scratched-off paint will be favorable.

These scratch-off game card programs have proven very successful, and one need only go to a convenience store in a state with a lottery to find three or four different lottery programs presented through scratch-off game cards. Similarly, scratch-off game cards are used for promotional programs by restaurants, mail order magazine companies, breakfast cereal producers, among a myriad of other programs.

With the proliferation of these game cards, the amount of coating that is removed has also increased. This scratched-off paint presents not only an annoyance because of the mess associated with it, but also raises environmental concerns because of its magnitude.

In the past, several devices have been presented to assist in removing the coating from these scratch-off game cards. For example, ticket scrapers were disclosed in U.S. Pat. Nos. 4,793,061 and 4,646,382. As another example, a lottery ticket processor was disclosed in U.S. Pat. No. 4,654,923. These are a few examples of the many devices that are designed for removing this coating. Unfortunately, many of these scrapers are difficult to use, inefficient, and do nothing to prevent the annoyance and potential environmental problems associated with the coating that has been scratched-off the game cards.

A device for scratching-off such coatings disclosed by Ellis in U.S. Pat. No. 4,881,291 presents a device with a receptacle for collecting the material that has been scraped off the game card. However, that device does not allow for the removal of the coating as efficiently as possible. Furthermore, that device is relatively complicated, and therefore relatively expensive.

Therefore, a need has arisen for a device for removing coatings from game cards that overcomes these problems with prior art devices. In particular, a need has arisen for a method and apparatus for removing coatings more efficiently than prior art techniques. Also, a need has arisen for an apparatus for removing coatings from game cards that is simple and inexpensive to produce. Also, a need has arisen for a method and apparatus with these advantages that also allow for the collection of the removed coating.

SUMMARY OF THE INVENTION

In accordance with the teachings of the present invention, a method and an apparatus for removing coatings from game cards are provided which substantially eliminate or reduce these and other problems associated with prior art devices and techniques. In particular, a device is presented which includes opposed blades for removing coatings in opposite directions. By using these opposed blades, coatings are removed from game cards much more efficiently. In particular, with the present invention, paint is removed in both forward and backward directions as the device is moved back and forth across the face of the game card. Furthermore, a receptacle is provided for collecting the removed coatings. In a particular embodiment, the removed coating is received and collected in a cavity of the housing.

In particular, a device for removing a coating from a card is provided in which a first blade and a second blade are associated with a housing. The first and second blades are opposed, such that the first blade scrapingly engages with the coating while the device is moved in a first direction and the second blade scrapingly engages with the coating while the device is moved in a second direction.

Also provided is a method of removing a coating from a card, which includes scraping a coating off in a first direction. The coating is also scraped off in a second direction opposite the first direction. The removed coating is automatically collected in a receptacle.

An important technical advantage of the present invention is the fact that scraping of the coating from a card is performed in opposite directions, thereby allowing for more efficient scraping. Furthermore, the removed coating is automatically collected in a cavity, thereby addressing mess and environmental concerns.

BRIEF DESCRIPTION OF THE DRAWINGS

For a more complete understanding of the present invention and the advantages thereof, reference is now made to the following description taken in conjunction with the accompanying drawings, in which like reference numbers indicate like features and wherein.

DETAILED DESCRIPTION OF THE INVENTION

Figure 1:
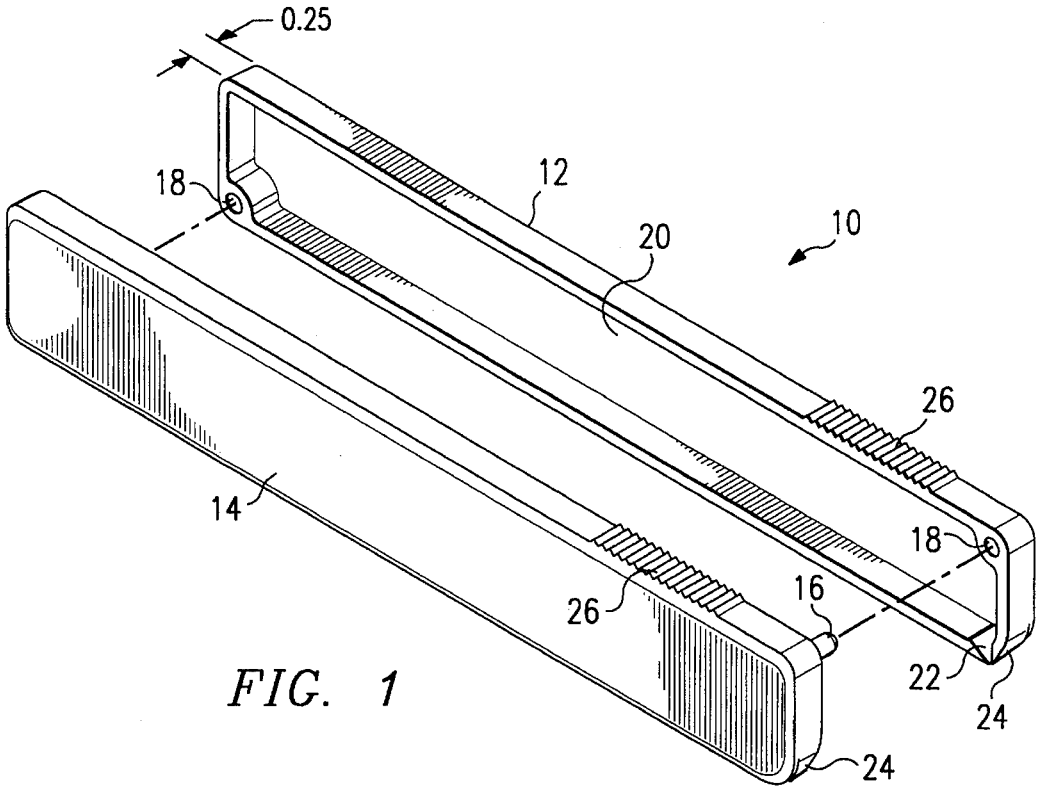
FIG. 1 is an exploded isometric view of a device for removing coatings from game cards according to the teachings of the present invention.

FIG. 1 illustrates an isometric exploded view of a device 10 according to the teachings of the present invention. As shown in FIG. 1, device 10 includes housing members 12 and 14. As shown in FIG. 1, housing member 12 is a female part, and housing member 14 is a male part. In particular, posts 16 of housing member 14 engage in holes 18 of housing member 12.

As can be seen from FIG. 1, the housing members 12 and 14 are formed so as to create a cavity (or receptacle) 20 when the housing members 12 and 14 are joined together. This cavity 20 is a receptacle for storing coatings that are scraped off of game cards. Such coatings are scraped off of the game cards by blades 22 and 24 of housing members 12 and 14. Also provided on housing members 12 and 14 are grips 26. Grips 26 are formed by making a non-smooth area, such as a ribbed area, on housing members 12 and 14. Grips 26 are located so that the thumb or a finger of a user will be less likely to slip while using the device 10.

The device shown in FIG. 1 may be made from crystal styrene, and formed through a mold process. As another example of a material, the device 10 may be formed of polycarbonate plastic. It should be understood that these materials are exemplary only, and many other plastics, or other materials, may be used without departing from the intended scope of the present invention.

Figure 2:
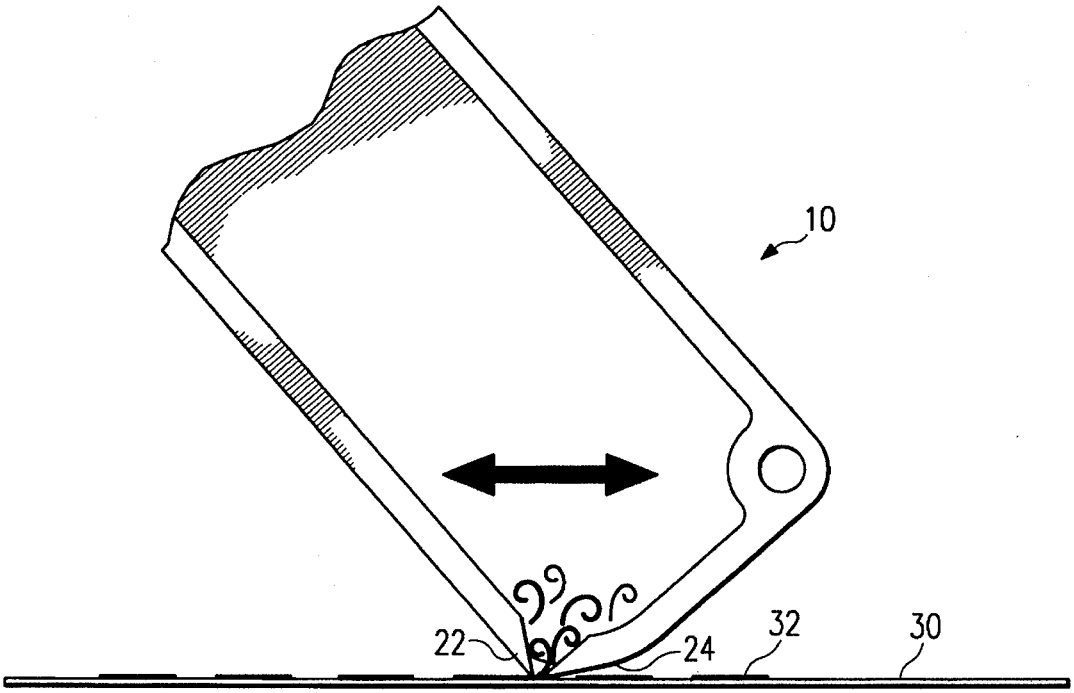
FIG. 2 is a sideview of a device according to the teachings of the present invention during use to remove paint in two directions.

FIG. 2 illustrates a partial sectional sideview of the device 10 during use. As shown in FIG. 2, the device is moved back and forth across the game card 30, which is coated, at least in part, by a coating 32. As discussed, this coating 32 covers giveaway information printed on the game card 30. The terms "coating" or "paint" are used in this patent to describe any material used for a coating to be removed. Similarly, "scraping" or "scratching" are used herein to describe removal of coatings by scraping, scratching, or any other mechanical technique.

As the device 10 is moved back and forth across the face of the game card 30, blades 22 and 24 engage with the coating 32 to remove it in both directions. The removed coating is collected within the cavity (or receptacle) 20 of device 10. In particular, as the device is moved in the direction toward the right side of the page of FIG. 2, blade 22 scrapes the coating 32 off of card 30. This coating is collected within the cavity 20 of the device 10. As the device 10 is moved in the direction toward the left of the page on which FIG. 2 is printed, blade 24 scrapes the coating 32 off of game card 30 for collection within cavity 20. This ability to scrape the coating off in opposite directions provides an important technical advantage of the present invention. Because coatings are scraped off by both the opposing blades 22 and 24, much more efficient removal is provided.

Figure 3:
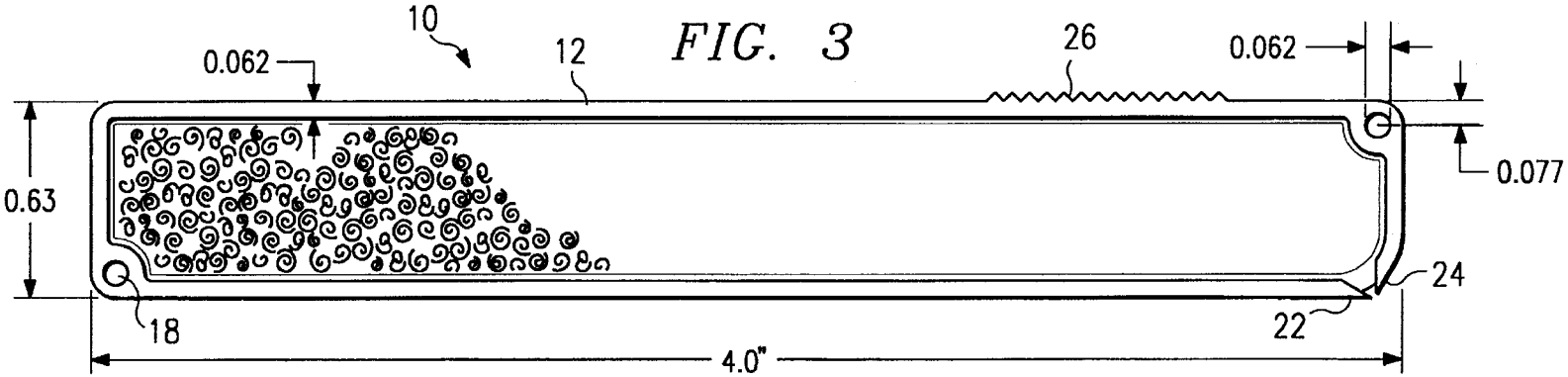
FIG. 3 is a sectional sideview of a device according to the teachings of the present invention.

FIG. 3 illustrates a sectional sideview of the device 10 according to the teachings of the present invention. As shown in FIG. 3, as the device is used, more and more paint shavings are collected within the device 10. Because the device 10 may be formed of a clear plastic, these shavings can be viewed. Thus, the device 10 provides an indication as to the number of game cards that have been scratched-off by a user. This information may be useful for various purposes, including accounting for the number of game cards that have been purchased by a user.

FIG. 3 also illustrates various dimensions, in inches (all dimensions shown in the FIGUREs are in inches), that may be used in forming the device 10. It should be understood that these dimensions are exemplary only, and other dimensions may be used as well without departing from the intended scope of the present invention. The sectional sideview of FIG. 3 illustrates female housing member 12. Thus, it illustrates the holes 18. The male housing member 14 is a mirror image of the female housing member 12, with the exception that the male housing member 14 includes posts 16 rather than holes 18. The posts 16 may be of the same diameter as the holes 18 of housing member 12. Furthermore, a typical length for the posts 16 is 0.110 inches. The depth of holes 18 should be sufficient to accommodate the length of posts 16.

It should be understood that the posts 16 and holes 18 shown in connection with the various FIGUREs are exemplary only. Thus, the device 10 may be joined with other techniques, such as by bonding or adhesion, or by more or less posts and holes, among other techniques, without departing from the intended scope of the present invention.

As discussed above, the coating that is scraped off of the game cards is collected within the cavity (or receptacle) 20 of device 10. With the dimensions shown in FIG. 3, coatings from approximately 200 game cards will fit within the device 10. Once the device 10 is full, it can be disposed of in an appropriate disposal receptacle. Thus, environmental concerns associated with the paint scraped off of the game cards are addressed by the present invention. Furthermore, the annoying mess from paint shavings is avoided with the present invention, since the paint shavings are collected within the cavity 20.

The device 10 may also be formed with a removal door to allow opening of the device and disposal of the paint shavings. With such a removal door, the device 10 may be periodically emptied. However, it is preferred that the device not have such a removal door, so as to more appropriately address environmental concerns. By not providing a removal door, the device 10 may be designed to be difficult to empty, and thus once the device 10 is full, it is disposed of in an appropriate disposal receptacle. Thus, much of the coatings from game cards may be accounted for through this disposal approach. The posts 16 and holes 18, shown in FIGS. 1 and 3, are designed to assist in this disposal approach, as it is difficult to separate the housing members 12 and 14 without breaking off one or both of the posts 16 in holes 18. Therefore, attempts to pull the members 12 and 14 apart and to empty the paint shavings is discouraged. This discouragement can also be accomplished by bonding the housing members together, among other techniques.

Figure 4:
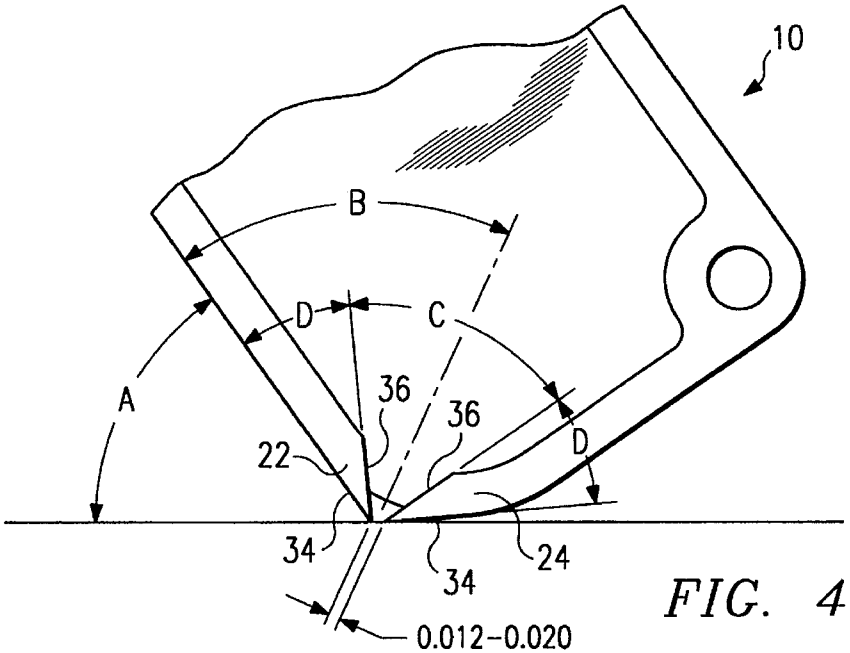
FIG. 4 is a partial sectional sideview illustrating the location of blades according to the teachings of the present invention.

FIG. 4 illustrates particular angles and dimensions for the blades 22 and 24. Angle A is the angle at which the device 10 is typically used, with respect to the game card 30. It has been found that a comfortable angle A at which the device 10 is used is 30 degrees. Angle B shown in FIG. 4 is referred as the start angle, and is a reference angle from the bottom of the device 10 to the center line of blades 22 and 24, and is used in orienting the blades. Angle B may be chosen for maximum efficiency of the blades 22 and 24. Because it appears that a comfortable angle for angle A is 30 degrees, angle B is in the range of 50 to 70 degrees for best efficiency, since the most efficient angle range for the orientation of center line of the blades appears to be from 80 to 100 degrees with respect to the game card 30 (angle A plus angle B). It should be understood, however, that angle B may be at other angles outside of this range as well, although less efficient operation may result.

If it is found that users are more comfortable with an angle A less than 30 degrees, then angle B can be accordingly increased for increased efficiency. If it is found that the most comfortable angle for angle A is greater than 30 degrees, then angle B can be accordingly reduced so as to keep the orientation of the blades at the most efficient angle.

Blades 22 and 24 each have two surfaces, a cutting surface 34 and a chip-relief surface 36, which define a blade edge. The angle between the cutting surface 34 and the chip-relief surface 36 is shown by angle D in FIG. 4. An exemplary angle for angle D is 30 degrees. With a 30-degree angle, the blades 22 and 24 are sharp enough to efficiently scrape off the coating. Reducing angle D results in a sharper blade. The sharper the blade, the less life it has, and the more likely it is to cut into the game card underlying the coating. Increasing angle D results in a duller blade, which has a longer life, but which is not as efficient in scraping off the coating.

As shown in FIG. 4, the cutting edge surface 34 of blade 22 is coincident with the bottom edge of device 10. It should be understood that this is exemplary only, and cutting edge 34 may diverge from the bottom edge of device 10, for example, as angle B changes.

Angle C shown in FIG. 4 is the chip-relief angle, and represents the angle between the chip-relief surfaces 36 of blades 22 and 24. It has been found that angle C is best set in the range of 50 to 70 degrees, although other angles may be also used without departing from the intended scope of the present invention. The angle between the cutting surfaces 34 of blades 22 and 24 is represented in FIG. 4 as the sum of angle C and the two angle Ds. This angle, referred to as the cutting-edge angle, has been found to be best set in the range of 110 to 130 degrees. However, it should be understood that other angles may be used as well without departing from the intended scope of the present invention.

As shown in FIG. 4, the gap width between blades 22 and 24 is best set in the range of 0.012 to 0.020 inches, although other widths may also be used without departing from the intended scope herein. With this range, the gap is wide enough to receive coatings scraped off of the game card, and yet narrow enough to prevent the scraped-off coatings from falling back through the gap. It has been observed that as the coatings are scraped off of the game card, chips are formed which slightly expand after they have been collected in the cavity (receptacle) 20 of the device 10, and thus will not fall out if the gap is properly sized.

The width of the gap between the blades depends in part on the thickness of the coating being scraped off. The range for the gap between blades 22 and 24 described above works well for various coating thicknesses. Because there does not appear to be a standard coating thickness, the gap thickness range discussed above may be expanded to account for thicker or thinner coating layers. It has been found that a thickness of 0.014 inches is particularly suited to many paint thicknesses.

With the embodiment shown in FIGS. 1 through 4, blades 22 and 24 have been discussed. It should be recognized that blades 22 and 24 are formed integrally as part of both housing members 12 and 14. Thus, four separate blades (two blades 22 and two blades 24) are provided. However, it should be understood that the blades may also be joined, so as to present only two blades. For example, the two blades 22 from each housing member may be joined together when the two housing members are joined together, for example by shaping them so as to snap together, or they may be bonded or joined with an adhesive. By joining the two blades 22 from the housing members, a single blade 22 is formed. Likewise, the two blades 24 from the two housing members may also be fixed together, either mechanically or through bonding or adhesive, to form a single blade 24.

As shown in the various FIGUREs, an important advantage of the present invention is the fact that blades 22 and 24 oppose one another. Thus, the device 10 scrapingly engages in opposite directions, and coatings are scraped off in opposite directions (both a forward and a backward direction), thereby allowing more efficient removal. Moreover, because the shavings from the coatings are collected within device 10 as it is used in both directions, environmental concerns and annoying mess concerns are addressed by the present invention.

Figure 5:
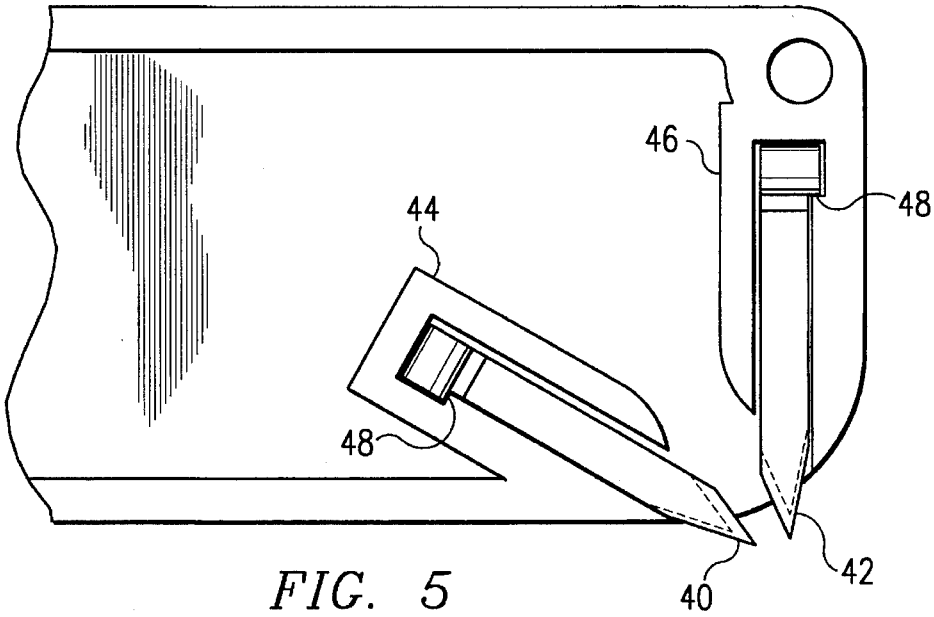
FIG. 5 is an exploded sideview of another embodiment of blades according to the teachings of the present invention.
Figure 6:
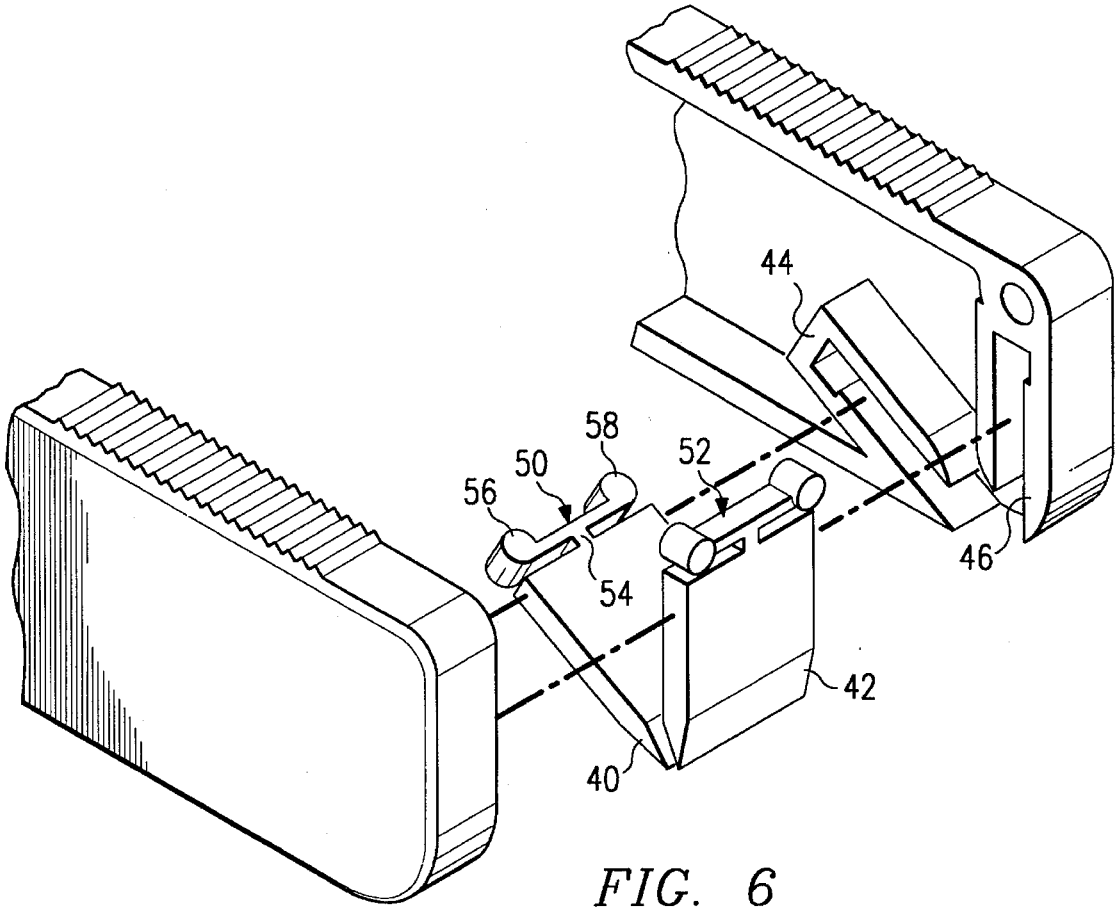
FIG. 6 is a isometric partial exploded view of the blades of the embodiment of FIG. 5.

FIGS. 5 and 6 present an alternative embodiment for the blades of the present invention. As shown in FIGS. 5 and 6, blades 40 and 42 are presented. These blades 40 and 42 are separate pieces that fit in blade holders 44 and 46. Blade holders 44 and 46 are each formed as part of housing members 12 and 14. Blade holders 44 and 46 are formed with slots to accommodate the blades 40 and 42. As shown in FIG. 5, the blades 40 and 42 are formed with a shoulder 48. The blade holders 44 and 46 are formed with a matching shoulder, such that the blades 40 and 42 are held within the holding members 44 and 46 and thus cannot slide out of the holding members 42 and 44.

Each of the blades 40 and 42 has a cutting edge and a chip-relief edge. An exemplary angle between the cutting edge and the chip-relief edge for each blade is 30 degrees. Other angles with respect to the orientation of the blades, the chip-relief edges, and the cutting edges of blades 40 and 42 are similar to those discussed above in connection with FIG. 4. The blades 40 and 42 of FIGS. 5 and 6 are formed from plastic, as described above. Thus, for example, they may be formed of crystal styrene.

FIG. 6 illustrates spring members 50 and 52 of blades 40 and 42, respectively. Spring members 50 and 52 are presented in a particular embodiment, and need not be included. With the spring members 50 and 52, the blades 40 and 42 spring inward and outward with respect to the holding members 44 and 46. During use, the blades 40 and 42 will be pushed back to their most inward position within holding members 44 and 46, and thus a gap between the blades will be provided for receiving paint scraped from the game card. As discussed above, this gap may be in the range of 0.012 to 0.020 inches for best results, although smaller or greater gap widths may also be used. When not in use, the blades 40 and 42 are extended slightly outward because of the spring members 50 and 52. When pushed outward in this manner, the gap between the two blades is narrowed, thus preventing any paint shavings from escaping out of the cavity 20 of the device 10.

In operation, spring members 50 and 52 flex to provide a spring function. In particular, ends 56 and 58 flex about fulcrum 54. Ends 56 and 58 contact the back of holding members 44 and 46, as shown in FIGS. 5 and 6. The particular shape of the spring members 50 and 52 shown in FIG. 6 is exemplary only, and other spring members may also be used without departing from the intended scope of the present invention.

The spring members 50 and 52 may be formed as part of blades 40 and 42, or they may be formed separately. Spring members 50 and 52 may also be comprised of a plastic, such as crystal styrene, although many other plastics may be used for any of the embodiments described in this patent.

As shown in FIGS. 5 and 6, the blades 40 and 42 are separate pieces. However, they may be formed integrally with the housing members. For example, the blades may be formed on part of one housing member, with blade holders being formed on the other housing member. Thus, the blades from the first housing member would fit in the blade holders of the other housing member when the housing members are brought together.

In summary, a method and device for removing coatings from game cards is provided. In particular, coatings can be removed in opposite directions, through the use of opposed blades for scraping in two directions. With this opposed-blade arrangement, more efficient removal is provided, since coatings are removed in two directions. Furthermore, coatings scraped off of game cards are collected in a receptacle on the device, thus addressing environmental and annoying mess concerns.

Although the present invention has been described in detail, it should be understood that various modifications, alterations, and substitutions can be made to this description without departing from intended scope of the present invention as defined by the appended claims.

What is claimed is:

1. A device for removing a coating from a card, comprising:

a housing having a cavity for containing scrapings of said coating, and having at least one opening for receiving said scrapings into said cavity;

a first blade connected to said housing, such that said first blade scrapingly engages with said coating when said device is moved in a first direction;

a second blade connected to said housing, such that said second blade scrapingly engages with the coating while the device is moved in a second direction.

2. The device of claim 1, wherein the first and second blades are formed integrally with the housing.

3. The device of claim 1, wherein the first and second blades each comprise:

a cutting surface; and a chip relief surface, the cutting surface and chip relief surface defining a blade edge.

4. The device of claim 1, wherein said first and second blades are separated by said at least one opening.

5. The device of claim 1, wherein said at least one opening is substantially in the range of 0,012 inches to 0.20 inches in width.

6. The device of claim 1, wherein the housing comprises:

a first member; and a second member, the first and second members joined to define said cavity for collecting removed coating.

7. The device of claim 6, wherein:

the first blade comprises a first component associated with the first member, and a second component associated with the second member; and the second blade comprises a third component associated with the first member, and a fourth component associated with the second member.

8. The device of claim 6 wherein said first blade is formed integrally with said first member, and said second blade is formed integrally with said second member.

9. The device of claim 6, wherein said first blade and said second blade are formed integrally with said first member.

10. The device of claim 1, wherein the first and second blades are formed separate from the housing, and wherein the housing includes slots for receiving the blades.

11. The device of claim 10, and further comprising spring members associated with the blades for springing the blades, such that a gap between the blades increases while the device is in use, and the gap decreases while the device is not in use.

12. The device of claim 1, wherein the first and second blades are formed separate from the housing, and wherein the housing includes slots for receiving the blades.

13. The device of claim 1, wherein said first blade directs said scrapings through said at least one opening when said device is moved in said second direction and said second blade directs said scrapings through said at least one opening when said device is moved in said first direction.

14. The device of claim 1, wherein said first blade and said second blade direct said scrapings into the same opening.

15. The device of claim 14, wherein said first blade and said second blade are at opposing sides of said opening.

16. The device of claim 1, wherein said housing is rectangular in shape and wherein said blades are at a corner of said housing.

17. A device for removing coating from a card, comprising:

a housing defining a cavity;

a first blade associated with the housing and having a first cutting surface and a first chip relief surface, the first cutting surface and first chip relief surface defining a first blade edge; and a second blade associated with the housing and opposed to the first blade, the second blade having a second cutting surface and a second chip relief surface, the second cutting surface and second chip relief surface defining a second blade edge, the first and second blade edges separated by a gap, the first and second cutting surfaces being separated by an angle substantially in the range of 110 degrees to 130 degrees;

such that the first blade scrapingly engages with the coating while the device is moved in a first direction, and the second blade scrapingly engages with the coating while the device is moved in a second direction, removed coating being collected in the cavity.

18. The device of claim 17, wherein the first and second blades are formed integrally with the housing.

19. The device of claim 17, wherein the gap is substantially in the range of 0.012 inches to 0.020 inches.

20. The device of claim 17, wherein the housing comprises:

a first member; and a second member, the first and second members joined to define the cavity for collecting removed coating.

21. The device of claim 20, wherein:

the first blade comprises a first component associated with the first member, and a second component associated with the second member; and the second blade comprises a third component associated with the first member, and a fourth component associated with the second member.

22. The device of claim 20 wherein said first blade is formed integrally with said first member, and said second blade is formed integrally with said second member.

23. A device for removing a coating from a card, comprising:

a housing having a cavity for containing scrapings of said coating, said housing having an opening for receiving said scrapings;

a first blade connected to said housing, such that said first blade scrapingly engages with said coating when said device is moved in a first direction and directs said scrapings into said opening when said device is moved in a first direction;

a second blade connected to said housing, such that said second blade scrapingly engages with said coating when said device is moved in a second direction and directs said scrapings into said opening when said device is moved in a second direction.

24. The device of claim 23, wherein said first blade and said second blade are at opposing sides of said opening.

25. The device of claim 23, wherein said housing is rectangular in shape and wherein said blades are at a corner of said housing.

26. The device of claim 23, wherein said housing is comprised of two pieces attached to define said cavity.

27. The device of claim 26, wherein said first blade is formed integrally with one of said pieces and said second blade is formed integrally with the other of said pieces.

28. The device of claim 26, wherein said first blade and said second blade are each comprised from two components, both component formed integrally with each of said two pieces.

29. The device of claim 26, wherein said first blade and said second blade are formed integrally with one of said two pieces.

30. The device of claim 23, further comprising spring members associated with each of said blades for springing said blades, such that said opening between the blades decreases while said device is not in use.

* * * * *